US009409301B2

(12) United States Patent
Kuijper et al.

(10) Patent No.: US 9,409,301 B2
(45) Date of Patent: Aug. 9, 2016

(54) CAP WITH MULTI-ANGLE ANNULAR CORRUGATION SURFACES FOR SHAVING APPARATUS

(75) Inventors: Andre Kuijper, Drachten (NL); Erik Houbolt, Drachten (NL); Martin Leonard Bakker, Drachten (NL); Willem Drachten, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 1569 days.

(21) Appl. No.: 12/515,963

(22) PCT Filed: Nov. 21, 2007

(86) PCT No.: PCT/IB2007/054733

§ 371 (c)(1),
(2), (4) Date: Jan. 14, 2010

(87) PCT Pub. No.: WO2008/065582

PCT Pub. Date: Jun. 5, 2008

(65) Prior Publication Data

US 2010/0139098 A1 Jun. 10, 2010

(30) Foreign Application Priority Data

Nov. 28, 2006 (EP) ..... 06124911

(51) Int. Cl.
*B26B 19/14* (2006.01)

(52) U.S. Cl.
CPC ..... *B26B 19/143* (2013.01)

(58) Field of Classification Search
CPC ..... B26B 19/143
USPC ..... 30/43.4–43.6
See application file for complete search history.

(56) References Cited

U.S. PATENT DOCUMENTS

| | | | | |
|---|---|---|---|---|
| 2,291,852 | A | 8/1942 | Weatherford | |
| 2,632,948 | A | 3/1953 | Konrad | |
| 3,116,551 | A | 1/1964 | Anton | |
| 3,636,626 | A | 1/1972 | Zuurveen | |
| 4,393,586 | A | 7/1983 | Hamashima et al. | |
| 5,544,414 | A * | 8/1996 | Dekker et al. | 30/43.6 |
| 5,625,950 | A | 5/1997 | Sterk et al. | |
| 5,867,908 | A * | 2/1999 | Van Veen et al. | 30/43.6 |
| 6,085,421 | A * | 7/2000 | Jorna et al. | 30/43.6 |
| 6,145,200 | A * | 11/2000 | Jorna et al. | 30/43.6 |
| 6,199,282 | B1 * | 3/2001 | Uchiyama et al. | 30/43.6 |
| 6,868,611 | B2 * | 3/2005 | Geertsma et al. | 30/43.6 |

(Continued)

FOREIGN PATENT DOCUMENTS

| | | |
|---|---|---|
| EP | 0566292 A1 | 10/1993 |
| EP | 1683609 A1 | 7/2006 |

(Continued)

*Primary Examiner* — Jason Daniel Prone

(57) ABSTRACT

A cap for a shaving head of a shaving apparatus has a skin contacting surface including at least two annular corrugations. The shape of the skin contacting surface of the cap is adapted to realizing a high feeling of comfort for a user of the shaving apparatus. A factor contributing to the feeling of comfort is that an annular central surface of an outermost corrugation has an orientation that is out of line with an expected course of an imaginary smooth flowing plane following a central surface of an adjacent corrugation, where a drooping configuration of the central surface of the outermost corrugation with respect to the central surface of the adjacent corrugation is realized.

13 Claims, 4 Drawing Sheets

(56) References Cited

U.S. PATENT DOCUMENTS

| | | | | |
|---|---|---|---|---|
| 6,968,620 | B2 * | 11/2005 | Okabe | 30/43.6 |
| 7,509,741 | B2 * | 3/2009 | Shimizu | 30/43.6 |
| 7,698,819 | B2 * | 4/2010 | De Wit et al. | 30/43.6 |
| 7,743,507 | B2 * | 6/2010 | Nakano | 30/43.4 |
| 8,061,040 | B2 * | 11/2011 | Walls | 30/43.6 |
| 2001/0039734 | A1 | 11/2001 | Kadijk et al. | |
| 2006/0179659 | A1 * | 8/2006 | Nakano | 30/43.6 |

FOREIGN PATENT DOCUMENTS

| | | | | |
|---|---|---|---|---|
| FR | 1101734 | A | | 10/1955 |
| JP | 54123361 | A | * | 9/1979 |
| JP | 60128281 | A | * | 7/1985 |
| JP | 60128282 | A | * | 7/1985 |
| JP | 08196753 | A | | 8/1996 |
| JP | 09122361 | A | | 5/1997 |
| WO | 03059584 | A1 | | 7/2003 |

* cited by examiner

CAP WITH MULTI-ANGLE ANNULAR CORRUGATION SURFACES FOR SHAVING APPARATUS

FIELD OF THE INVENTION

The present invention relates to a cap which is intended to be applied in a shaving head of a shaving apparatus, and which has a surface for contacting skin to be shaved, wherein the skin contacting surface comprises at least two annular corrugations, wherein each annular corrugation has an annular central surface, an inner annular boundary surface and an outer annular boundary surface. The present invention also relates to a shaving head having such a cap and a cutting member which is adapted to cutting through hair; a unit which is intended to be applied in a shaving apparatus, comprising a portion of a housing of the shaving apparatus, and at least one such a shaving head; and a shaving apparatus, comprising at least one such a shaving head.

It is generally known that a shaving apparatus is applicable for the purpose of shaving off hair. A well-known type of shaving apparatus is an electric shaving apparatus, i.e. a shaving apparatus comprising an electric motor for driving one or more components of the shaving apparatus.

The electric shaving apparatus comprises at least one shaving head, which is a composite element of the shaving apparatus, and which serves for actually catching hairs and performing a hair cutting action. To this end, among other things, the shaving head comprises a cap which has a surface for contacting skin to be shaved, wherein the cap is provided with apertures for catching hairs and letting through hairs to an interior space of the shaving head. In this interior space, close to the cap, a cutting member is arranged, which is driven such as to move with respect to the cap during operation of the shaving apparatus, so that hairs extending through the apertures of the cap are cut off. It is clear that the cap also has a function in protection the skin, as the cutting member is shielded off from the skin by the cap.

For the purpose of shaving a certain area of skin, the cutting member is driven, the shaving head is put in contact with the skin, and the shaving apparatus is moved along the skin while the contact between the shaving head and the skin is maintained, so that a continuous process of catching hairs and cutting off hairs is performed.

Among other things, the shape of the cap of the at least one shaving head of the shaving apparatus is an important factor for determining a sensation which is experienced by a person whose skin is subjected to a shaving operation. An example of another important factor in this respect is the extent to which the shaving head is movable with respect to a portion of the shaving apparatus which is held by a user during a shaving operation.

A wide variety of caps is known and applied in practice. Usually, a shaving head of a so-called rotary shaving apparatus, i.e. a shaving apparatus in which the cutting member of the at least one shaving head is rotatably arranged, is provided with a cap having a circular circumference. In a particular type of cap, a skin contacting surface of the cap comprises three concentrically arranged annular corrugations, wherein the apertures for catching hairs are located in these annular corrugations.

It is an objective of the present invention to provide a cap which is intended to be applied in a shaving head of a shaving apparatus, and which is shaped in such a way that it is capable of realizing an increased feeling of comfort for a user of a shaving apparatus comprising at least one shaving head having this cap. This objective is achieved by a cap having a skin contacting surface which comprises at least two annular corrugations, wherein each annular corrugation has an annular central surface, an inner annular boundary surface and an outer annular boundary surface, and wherein, in a direction from a center of the cap to an outer periphery of the cap, a course of the central surface of an outmost annular corrugation significantly deviates from an expected course of an imaginary smooth flowing plane following the at least one central surface of the at least one other annular corrugation, wherein the central surface of the outmost annular corrugation slants away from the imaginary smooth flowing plane following the at least one central surface of the at least one other annular corrugation.

According to the present invention, the central surface of the outmost annular corrugation of the cap is not on an imaginary smooth flowing plane with the central surface(s) of the other annular corrugation(s). In this way, it is possible to obtain a clearly drooping configuration of the central surface of the outmost annular corrugation with respect to the central surface(s) of the other annular corrugation(s). Application of the cap according to the present invention appears to enhance the feeling of comfort of the user, indeed. An explanation is found in the fact that a barrier which is constituted by the outer annular boundary surface of the outmost annular corrugation is lower in the cap according to the present invention than in any of the known caps having at least two annular corrugations. In this way, it is achieved that when the user moves the cap along his or her skin, an ongoing process in which fresh portions of skin are encountered by the outer annular boundary surface of the outmost annular corrugation of the cap takes place in a smoother manner, wherein lower pressure peaks on the outmost annular corrugation are realized.

Advantageously, in the cap according to the present invention, the central surface of the outmost annular corrugation is significantly slanted with respect to the central surface of an annular corrugation which is adjacent to the outmost annular corrugation, wherein an angle between an overall orientation of the central surface of the outmost annular corrugation and an overall orientation of the central surface of the annular corrugation which is adjacent to the outmost annular corrugation is significantly larger than 0°. For example, this angle may be larger than 10°, so that the desired effect of a reduction of pressure peaks on the outmost annular corrugation is actually obtained, and the feeling of comfort during movement of the cap along an area of skin is increased, as the outmost annular corrugation functions as a run-on to the adjacent annular corrugation, as it were.

For sake of completeness, it is noted that the concept of overall orientation of the central surface should be understood such as to relate to an average or main orientation of the central surface. In the direction from the center of the cap to the outer periphery of the cap, the central surface may be convexly curved, and in that case, the overall orientation of the central surface should be understood such as to be an orientation of an average tangent plane of the central surface.

In a preferred embodiment, the cap according to the present invention comprises at least three annular corrugations, wherein an angle between an overall orientation of the central surface of the outmost annular corrugation and an overall orientation of the central surface of an annular corrugation which is adjacent to the outmost annular corrugation is larger than an angle between an overall orientation of the central surface of an inmost annular corrugation and an overall orientation of the central surface of an annular corrugation which is adjacent to the inmost annular corrugation. It is advantageous if the central surface of the inmost annular corrugation has a less drooping configuration than the central surface of the outmost annular corrugation, in order to achieve that the skin is practically not deformed and subjected to pressure any further when the cap is moved along the skin, and the skin gets contacted by the inmost annular corrugation.

In a case in which the central surfaces of the annular corrugations are convexly curved, in a direction from a center of the cap to an outer periphery of the cap, radii of curvature of the central surfaces of different annular corrugations may be substantially the same. In a known cap having three annular corrugations, the central surfaces of the annular corrugations are curved according to an imaginary circle having a certain radius, which is relatively large in order to have a substantially planar appearance of the skin contacting surface of the cap, which comprises these central surfaces. It appears that the feeling of comfort is increased when the central surfaces of the annular corrugations are individually curved, wherein the radii of curvature are relatively small.

Furthermore, it appears to be advantageous if the central surface of the outmost annular corrugation is extending at another level than the central surface of an annular corrugation which is adjacent to the outmost annular corrugation, such that, when the cap is seen in an orientation in which it is normally put in contact with the skin, the outmost annular corrugation is somewhat retracted with respect to the adjacent annular corrugation. Likewise, it appears to be advantageous if the central surface of an inmost annular corrugation is extending at another level than the central surface of an annular corrugation which is adjacent to the inmost annular corrugation. In this way, it is realized that an overall shape of a portion of the cap where the annular corrugations are located is toroidal.

The cap according to the present invention may be applied in any suitable type of shaving head, and the shaving head having this cap may be applied in any suitable type of shaving apparatus. As the cap according to the present invention is capable of increasing the feeling of comfort for a user, due to shape features, it is very well possible to apply the shaving head having the cap in a shaving apparatus in which the shaving head is flexibly or fixedly connected to a housing portion of the shaving apparatus, and still obtain satisfying results.

The above-described and other aspects of the present invention will be apparent from and elucidated with reference to the following description of an embodiment of the cap according to the present invention.

The present invention will now be explained in greater detail with reference to the figures, in which equal or similar parts are indicated by the same reference signs, and in which:

FIG. 1 diagrammatically shows a perspective view of a shaving apparatus having three shaving heads comprising a cap according to the present invention;

Figure 1:
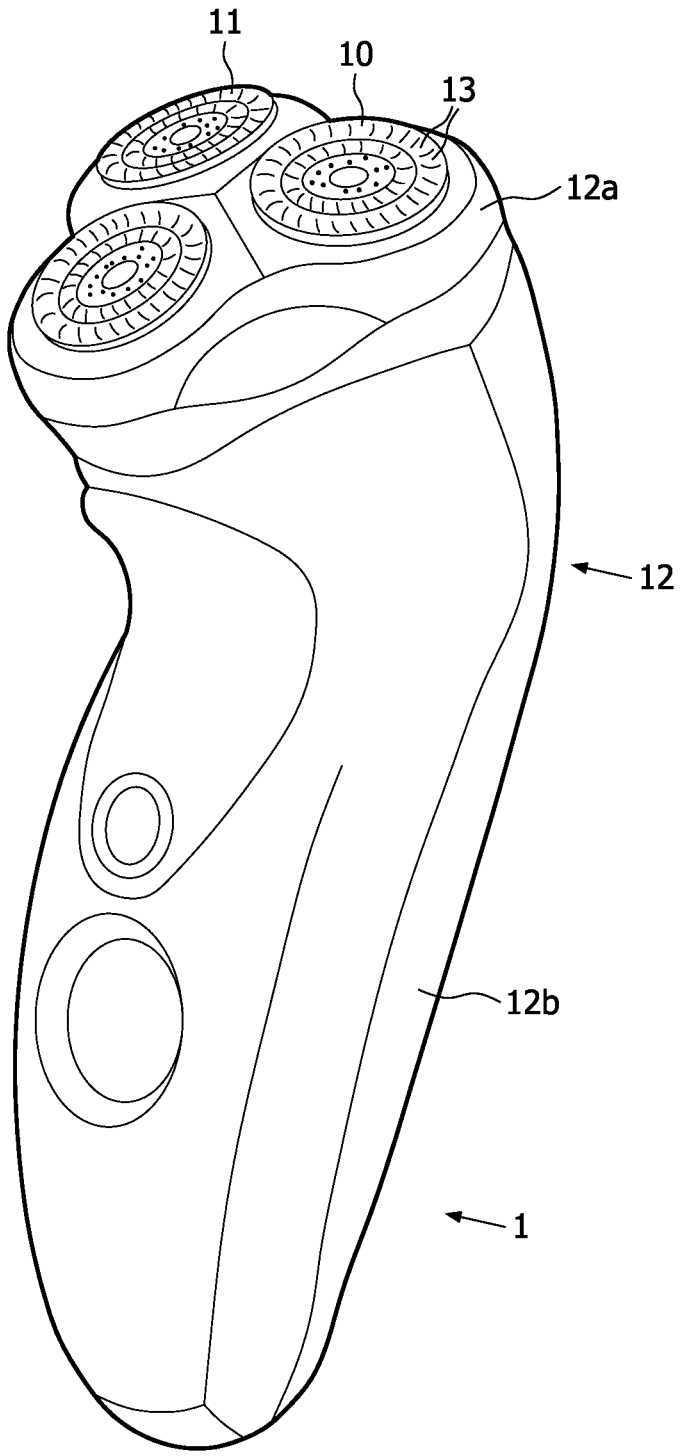

FIG. 1 shows an electric shaving apparatus 1 having three shaving heads 10, wherein each shaving head 10 comprises a cap 11 according to the present invention. The shaving heads 10 are mounted in a shaving portion 12*a* of a housing 12 of the shaving apparatus 1. The housing 12 of the shaving apparatus 1 further comprises a grip portion 12*b*, which is intended to be taken hold of by a user of the shaving apparatus 1. Inside the grip portion 12*b*, several components of the shaving apparatus 1, including an electric motor (not shown) and a battery (not shown) are arranged. In a practical embodiment of the shaving apparatus 1, the caps 11 of the shaving heads 10 are manufactured from metal, while the housing 12 is manufactured from plastic.

Besides a cap 11, each shaving head 10 of the shaving apparatus 1 comprises a rotatably-arranged cutting member (not shown), which is adapted to cutting through hair, and which is arranged in an interior of the shaving head 10, close to the cap 11. The cap 11 comprises a number of apertures 13 for letting through hair to be shaved off to the interior of the shaving head 10.

The shaving apparatus 1 is suitable to be used for the purpose of shaving an area of skin, and is operated as follows. A user takes hold of the grip portion 12*b* of the housing 12 of the shaving apparatus 1, and places the shaving portion 12*a* of the housing 12 against the skin, such that the caps 11 of the shaving heads 10 contact the skin. Furthermore, the user moves the shaving portion 12*a* along the skin, so that a continuous process during which hairs are caught in the apertures 13 of the caps 11 takes place. In an operative state of the shaving apparatus 1, the electric motor is switched on, so that the cutting members are driven such as to perform a rotating movement. Due to this movement of the cutting members with respect to the associated caps 11, hairs which are caught in the apertures 13 of the caps 11 are cut off, wherein these hairs are received in a hair chamber (not shown) which is in communication with the interior of the shaving heads 10.

Figure 2:
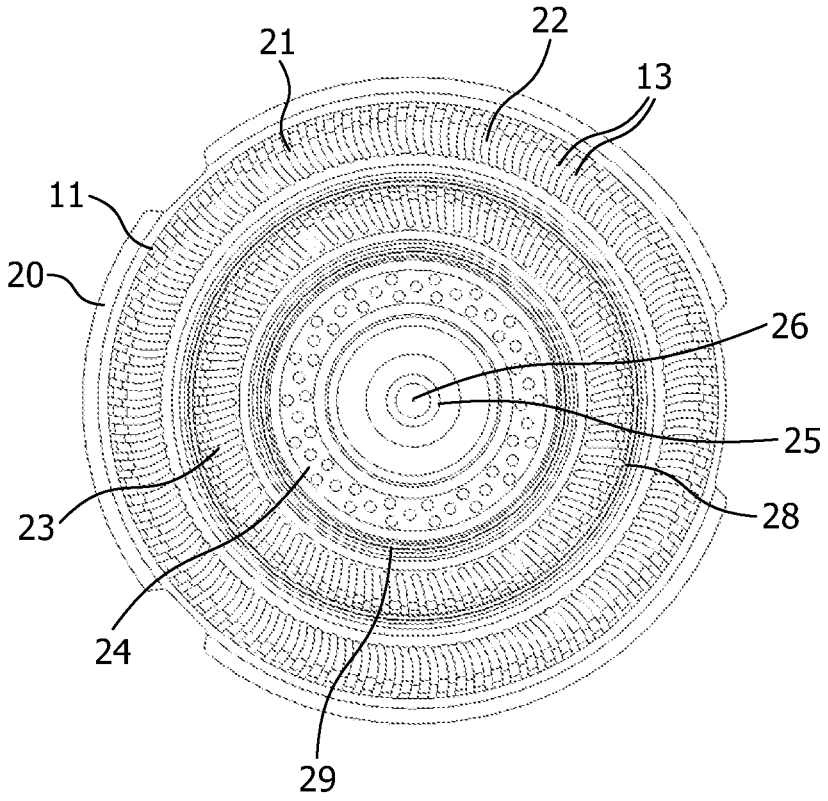
FIG. 2 shows a top view of a preferred embodiment of the cap according to the present invention.
Figure 3:
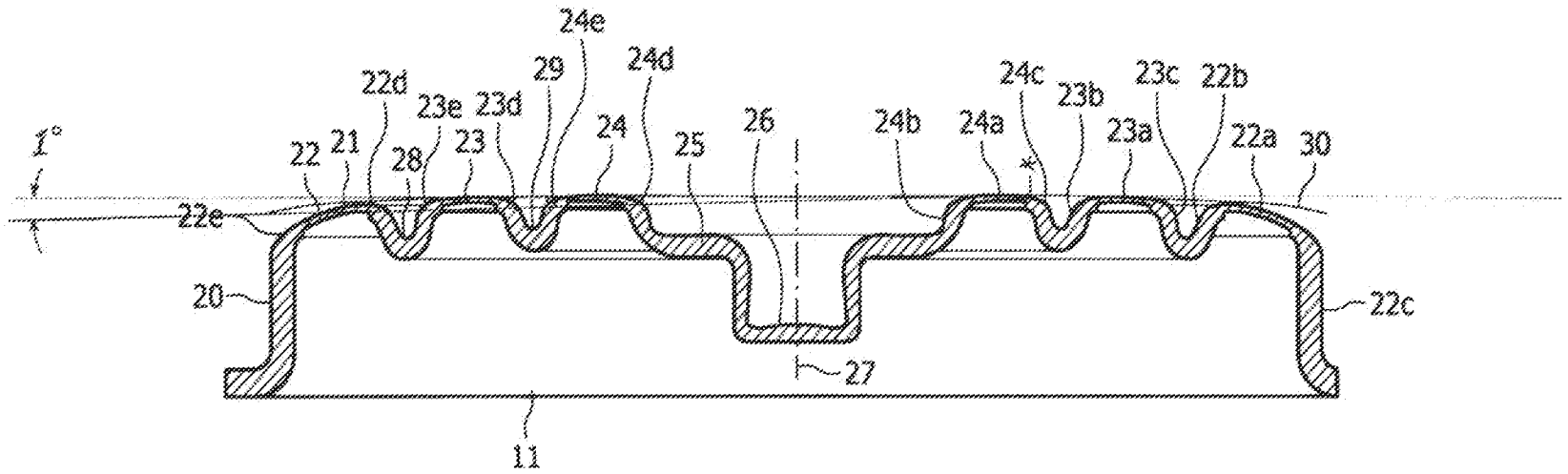
FIG. 3 shows a side view of a cross-section of the preferred embodiment of the cap according to the present invention.

FIGS. 2 and 3 show views of a preferred embodiment of the cap 11 according to the present invention.

The cap 11 has a circular outer periphery 20. In a practical embodiment of the cap 11, a diameter of the cap 11 may be in an order of 20 mm. A skin contacting surface 21 of the cap 11, which is intended to be facing outwardly when the cap 11 is mounted in a shaving head 10, comprises three annular corrugations 22, 23, 24, namely an outmost annular corrugation 22, a central annular corrugation 23, and an inmost annular corrugation 24. In the following, for sake of clarity, a side of the cap 11 where the skin contacting surface 21 is will be regarded as being a top side of the cap 11.

The annular corrugations 22, 23, 24 are concentrically arranged, and are located around a centre portion 25 of the cap 11, which has a centrally located recessed portion 26. In FIG. 3, a central axis of the cap 11 is indicated by means of a dot and dash line 27.

Each of the annular corrugations 22, 23, 24 has an annular central surface 22*a*, 23*a*, 24*a*, which is located between an inner annular boundary surface 22*b*, 23*b*, 24*b* on one side and an outer annular boundary surface 22*c*, 23*c*, 24*c* on another side. The annular central surface 22*a*, 23*a*, 24*a* is connected to an associated annular boundary surface 22*b*, 22*c*, 23*b*, 23*c*, 24*b*, 24*c* through a round transition surface 22*d*, 22*e*, 23*d*, 23*e*, 24*d*, 24*e*. In the shown example, each transition surface 22*d*, 22*e*, 23*d*, 23*e*, 24*d*, 24*e* is curved according to two different radii, wherein a largest radius is present at the side of the central surface 22*a*, 23*a*, 24*a*.

A portion of the skin contacting surface 21 of the cap 11 where the inner annular boundary surface 22*b* of the outmost annular corrugation 22 is connected to the outer annular boundary surface 23*c* of the central annular corrugation 23 constitutes an outer recess 28 of the skin contacting surface 21, whereas a portion of the skin contacting surface 21 where the inner annular boundary surface 23*b* of the central annular corrugation 23 is connected to the outer annular boundary surface 24*c* of the inmost annular corrugation 24 constitutes an inner recess 29 of the skin contacting surface 21.

In a direction from the central axis 27 of the cap 11 to the outer periphery 20 of the cap 11, the central surfaces 22*a*, 23*a*, 24*a* are convexly curved. In the shown example, the radii of the central surfaces 22*a*, 23*a*, 24*a* are substantially the same. In case the diameter of the cap 11 is in the order of 20 mm, as mentioned in the foregoing, a suitable value of the radii of curvature is 7 mm.

A notable feature of the skin contacting surface 21 of the cap 11 is that in the direction from the central axis 27 of the cap 11 to the outer periphery 20 of the cap 11, the central surface 22*a* of the outmost annular corrugation 22 is slanted downwardly with respect to an imaginary smooth flowing plane following the central surfaces 23*a*, 24*a* of the other annular corrugations 23, 24, which is indicated in FIG. 3 by means of a thin line 30. In other words, the central surface 22*a* of the outmost annular corrugation 22 is drooping with respect to the central surfaces 23*a*, 24*a* of the other annular corrugations 23, 24, while the central surface 22*a* of the outmost annular corrugation 22 is significantly slanted with respect to the central surface 23*a* of the central annular corrugation 23.

Figure 4:
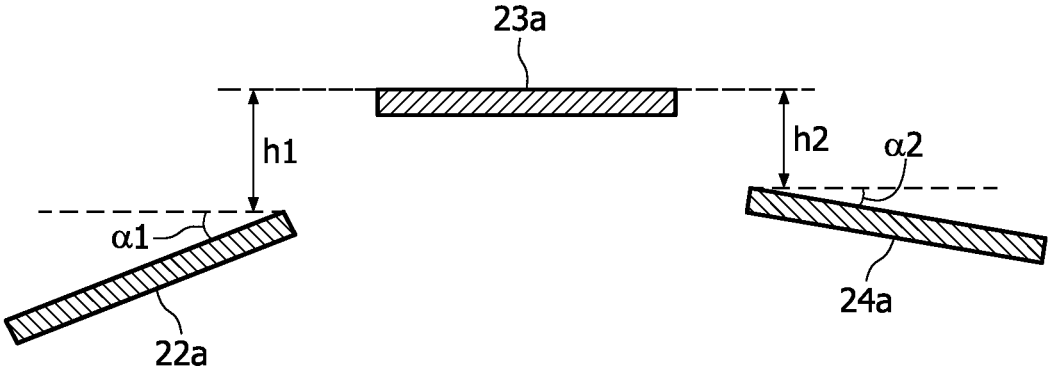
FIG. 4 diagrammatically illustrates a configuration of central surfaces of annular corrugations of the preferred embodiment of the cap according to the present invention.

FIG. 4 diagrammatically illustrates a configuration of the central surfaces 22*a*, 23*a*, 24*a* of the annular corrugations 22, 23, 24 of the cap 11. In this diagrammatic depiction, a side view of a cross-section of portions of the annular corrugations 22, 23, 24 having the central surfaces 22*a*, 23*a*, 24*a* is shown, wherein the central surfaces 22*a*, 23*a*, 24*a* are shown as being planar. Furthermore, the central surface 23*a* of the central annular corrugation 23 is shown in a horizontal orientation. A height difference between the central surface 23*a* of the central annular corrugation 23 and the central surface 22*a* of the outmost annular corrugation 22, at the side of the central annular corrugation 23, is indicated under h1, and a height difference between the central surface 23*a* of the central annular corrugation 23 and the central surface 24*a* of the inmost annular corrugation 24, at the side of the central annular corrugation 23, is indicated under h2. An angle of the central surface 22*a* of the outmost annular corrugation 22 to the horizontal is indicated under $\alpha$1, and an angle of the central surface 24*a* of the inmost annular corrugation 24 to the horizontal is indicated under $\alpha$2.

In the cap 11 according to the present invention as shown in FIGS. 2 and 3, both height differences h1 and h2 are larger than zero. The same applies to the angles $\alpha$1 and $\alpha$2, wherein the angle $\alpha$1 of the central surface 22*a* of the outmost annular corrugation 22 to the horizontal is larger than the angle $\alpha$2 of the central surface 24*a* of the inmost annular corrugation 24 to the horizontal. In view of the fact that in the shown example, both angles $\alpha$1 and $\alpha$2 are larger than zero, it is possible to denote an overall shape of the cap 11 where the annular corrugations 22, 23, 24 are located as toroidal.

In general, it is true that both height differences h1 and h2 and the angle $\alpha$1 of the central surface 22*a* of the outmost annular corrugation 22 to the horizontal are larger than zero, while the angle $\alpha$2 of the central surface 24*a* of the inmost annular corrugation 24 to the horizontal is larger than or equal to zero.

It is noted that, in view of the fact that in FIG. 4, the central surface 23*a* of the central annular corrugation 23 is oriented according to the horizontal, an angle between an overall orientation of the central surface 22*a* of the outmost annular corrugation 22 and an overall orientation of the central surface 23*a* of the central annular corrugation 23 is equal to the angle $\alpha$1 of the central surface 22*a* of the outmost annular corrugation 22 to the horizontal, and an angle between an overall orientation of the central surface 24*a* of the inmost annular corrugation 24 and the overall orientation of the central surface 23*a* of the central annular corrugation 23 is equal to the angle $\alpha$2 of the central surface 24*a* of the inmost annular corrugation 24 to the horizontal.

The cap 11 according to the present invention is designed for providing a user of the shaving apparatus 1 which is equipped with shaving heads 10 having the cap 11 with a great sensation of comfort. This is mainly achieved on the basis of the shape of the skin contacting surface 21 of the cap 11, which is adapted to obtaining a smooth passage of the cap 11 over the skin of the user, while avoiding high pressure peaks. In other words, the cap 11 has a comfort profile, wherein an important factor contributing to the feeling of comfort is the drooping configuration of the central surface 22*a* of the outmost annular corrugation 22 with respect to the central surfaces 23*a*, 24*a* of the other annular corrugations 23, 24. For example, in the preferred embodiment of the cap 11 according to the present invention as shown, the angle between the overall orientation of the central surface 22*a* of the outmost annular corrugation 22 and the overall orientation of the central surface 23*a* of the central annular corrugation 23 is approximately 14°. In general, satisfying results are obtained if this angle is larger than 10°, but that does not alter the fact that the angle may also have a value which is between 0° and 10°.

Other important factors contributing to a feeling of comfort are the convexly curved shape of the central surfaces 22*a*, 23*a*, 24*a* of the annular corrugations 22, 23, 24, and the toroid overall shape of the portion of the cap 11 where the annular corrugations 22, 23, 24 are located.

Particularly, in the shown example of the cap 11 according to the present invention, the angle $\alpha$1 of the central surface 22*a* of the outmost annular corrugation 22 to the horizontal is 14°, the angle $\alpha$2 of the central surface 24*a* of the inmost annular corrugation 24 to the horizontal is 1°, the height difference h1 between the central surface 23*a* of the central annular corrugation 23 and the central surface 22*a* of the outmost annular corrugation 22, at the side of the central annular corrugation 23, is 0.09 mm, and the height difference h2 between the central surface 23*a* of the central annular corrugation 23 and the central surface 24*a* of the inmost annular corrugation 24, at the side of the central annular corrugation 23, is 0.01 mm. Other suitable combinations of values of the angles and height differences as mentioned are feasible within the scope of the present invention.

The cap 11 is suitable to be applied in many types of shaving heads 10 and shaving apparatus 1 comprising at least one shaving head 10. In view of the fact that the cap 11 according to the present invention as such is capable of causing a user to experience a great feeling of comfort, the cap 11 is particularly suitable to be applied in shaving heads 10 which are flexibly or fixedly connected to the shaving portion 12*a* of the housing 12 of a shaving apparatus 1. It is noted that in such a shaving apparatus 1, the shaving portion 12*a* of the housing 12 may be arranged such as to be movable to a limited extent with respect to the grip portion 12*b* of the housing 12, but this is not essential.

It will be clear to a person skilled in the art that the scope of the present invention is not limited to the example discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiment.

In this respect, it is noted that the scope of the present invention is not restricted to caps 11 having three annular corrugations 22, 23, 24. The present invention also relates to caps having only two annular corrugations, or caps having more than three annular corrugations 22, 23, 24. Furthermore, it is noted that the number of shaving heads 10 of a shaving apparatus 1 in which the present invention is applied may be chosen freely.

Variations to the disclosed embodiment can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In the foregoing, a cap 11 is disclosed, which is suitable to be applied in a shaving head 10 of a shaving apparatus 1, wherein the shaving head 10 further comprises a movably arranged cutting member adapted to cutting through hair. The cap 11 has a skin contacting surface 21 which comprises at least two annular corrugations 22, 23, 24. In an area of the cap 11 where these annular corrugations 22, 23, 24 are located, the cap 11 is provided with apertures 13 for catching and letting through hair to be cut off.

The shape of the skin contacting surface 21 of the cap 11 is adapted to realizing a high feeling of comfort for a user of a shaving apparatus 1 which is equipped with at least one shaving head 10 comprising the cap 11. A factor contributing to the feeling of comfort is that an annular central surface 22*a* of an outmost annular corrugation 22 has an orientation which is out of line with an expected course of an imaginary smooth flowing plane 30 following the at least one central surface 23*a*, 24*a* of the at least one other annular corrugation 23, 24, wherein a drooping configuration of the central surface 22*a* of the outmost annular corrugation 22 with respect to the at least one central surface 23*a*, 24*a* of the at least one other annular corrugation 23, 24 is realized.

The invention claimed is:

1. A cap for a shaving head of a shaving apparatus, said cap having a plurality of cooperating annular corrugations disposed about a central axis of the cap and including, relative to said central axis, an outermost annular corrugation, an innermost annular corrugation, and an intermediate annular corrugation disposed between the outermost and innermost annular corrugations, each of said annular corrugations having a central skin-contacting surface in which apertures are provided for receiving hairs to be cut, an inner boundary surface and an outer boundary surface and being formed such that, when viewed in a planar cross section aligned with said central axis and with the central skin-contacting surfaces facing in an upward direction:

a) the central skin-contacting surface of the intermediate annular corrugation extends in a transverse direction relative to the central axis;

b) the central skin-contacting surface of the outermost annular corrugation slants in a downward direction and forms a first slant angle relative to the transverse direction; and c) the central skin contacting surface of the innermost annular corrugation slants in a downward direction and forms a second slant angle relative to the transverse direction;

said first slant angle being larger than said second slant angle.

2. The cap according to claim 1 where the first slant angle is between 0° and 10°.

3. The cap according to claim 1 where the first slant angle is equal to or larger than 10°.

4. The cap according to claim 1 where, when viewed in said planar cross section, the central skin-contacting surfaces of the outermost annular corrugation and the intermediate annular corrugation are convexly curved.

5. The cap according to claim 4 where said convexly-curved central skin-contacting surfaces have radii of curvature that are substantially equal.

6. The cap according to claim 1 where the central skin-contacting surface of the outermost annular corrugation and the central skin-contacting surface of the intermediate annular corrugation are disposed at different positions as measured along the central axis.

7. The cap according to claim 1 where the central skin-contacting surface of the innermost annular corrugation and the central skin-contacting surface of the intermediate annular corrugation are disposed at different positions as measured along the central axis.

8. The cap according to claim 1 where an overall shape of a portion of the cap where the annular corrugations are located is toroidal.

9. An electric shaving apparatus comprising a housing having a shaving portion on which at least one shaving head is mounted, said shaving head including a cap having a plurality of cooperating annular corrugations disposed about a central axis of the cap and including, relative to said central axis, an outermost annular corrugation, an innermost annular corrugation, and an intermediate annular corrugation disposed between the outermost and innermost annular corrugations, each of said annular corrugations having a central skin-contacting surface in which apertures are provided for receiving hairs to be cut, an inner boundary surface and an outer boundary surface, and being formed such that, when viewed in a planar cross section aligned with said central axis and with the central skin-contacting surfaces facing in an upward direction:

a) the central skin-contacting surface of the intermediate annular corrugation extends in a transverse direction relative to the central axis;

b) the central skin-contacting surface of the outermost annular corrugation slants in a downward direction and forms a first slant angle relative to the transverse direction; and c) the central skin contacting surface of the innermost annular corrugation slants in a downward direction and forms a second slant angle relative to the transverse direction;

said first slant angle being larger than said second slant angle.

10. The electric shaving apparatus as in claim 9 where the first slant angle is equal to or larger than 10°.

11. The electric shaving apparatus as in claim 9 where the transverse direction is approximately orthogonal to the central axis.

12. The electric shaving apparatus as in claim 9 where the central skin-contacting surface of the outermost annular corrugation is disposed below the central skin-contacting surface of the intermediate annular corrugation, when viewed in the planar cross section aligned with said central axis and with the central skin-contacting surfaces facing in an upward direction.

13. The electric shaving apparatus as in claim 9 where the central skin-contacting surface of the innermost annular corrugation is disposed below the central skin-contacting surface of the intermediate annular corrugation, when viewed in the planar cross section aligned with said central axis and with the central skin-contacting surfaces facing in an upward direction.

* * * * *